US008976041B2

(12) United States Patent
Buckel

(10) Patent No.: US 8,976,041 B2
(45) Date of Patent: Mar. 10, 2015

(54) TRAFFIC ANALYSIS USING WIRELESS RECEIVERS AND VEHICLE DETECTION DEVICES

(71) Applicant: Wolfgang Erich Buckel, Austin, TX (US)

(72) Inventor: Wolfgang Erich Buckel, Austin, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 185 days.

(21) Appl. No.: 13/676,843

(22) Filed: Nov. 14, 2012

(65) Prior Publication Data

US 2014/0132425 A1 May 15, 2014

(51) Int. Cl.
*G08G 1/01* (2006.01)
*G08G 1/08* (2006.01)
*G08G 1/017* (2006.01)

(52) U.S. Cl.
CPC . *G08G 1/08* (2013.01); *G08G 1/017* (2013.01)
USPC ..... 340/933; 340/934; 701/119; 701/117

(58) Field of Classification Search
CPC ..... G08G 1/00; G08G 1/01; G08G 1/016
USPC ..... 340/933
See application file for complete search history.

(56) References Cited

U.S. PATENT DOCUMENTS

| | | | | |
|---|---|---|---|---|
| 6,262,673 | B1 | 7/2001 | Kalina | |
| 6,483,443 | B1 * | 11/2002 | Lees et al. | 340/933 |
| 8,566,011 | B2 * | 10/2013 | Tas et al. | 701/119 |
| 2010/0254282 | A1 | 10/2010 | Campbell et al. | |
| 2010/0302070 | A1 | 12/2010 | Puckett | |
| 2011/0156924 | A1 * | 6/2011 | Nadeem et al. | 340/905 |
| 2012/0081235 | A1 * | 4/2012 | Nadeem et al. | 340/933 |
| 2012/0083996 | A1 * | 4/2012 | Tas et al. | 701/119 |

* cited by examiner

*Primary Examiner* — Kerri McNally

(57) ABSTRACT

Methods, systems, and devices for monitoring roadway traffic. A method includes transmitting wireless signals from at least one roadside equipment (RSE) device and receiving responses by the RSE device from a wireless device, the responses including a unique identifier corresponding to the wireless device. The method includes determining a signal strength of each of the responses by the RSE device and transmitting response data from the RSE device to a control system, the response data including the unique identifier, the signal strength of each of the responses, and times that the responses were received. The method includes detecting at least one vehicle by the control system using a vehicle detection device and associating the response data with the detected vehicle. The method includes determining traffic information associated with the wireless device based on the received response data and the associated detected vehicle.

16 Claims, 4 Drawing Sheets

TRAFFIC ANALYSIS USING WIRELESS RECEIVERS AND VEHICLE DETECTION DEVICES

CROSS-REFERENCE TO OTHER APPLICATION

This application has some subject matter in common with commonly-assigned U.S. Provisional Patent Applications 61/388,014, filed Sep. 30, 2010, and 61/388,012, filed Sep. 30, 2010, which are hereby incorporated by reference. This application also has some subject matter in common with commonly-assigned U.S. patent application Ser. No. 13/232,248 (now published as United States Patent Application Publication US2012/0081235) and Ser. No. 13/232,231 (now published as United States Patent Application Publication US2012/0083996), which are hereby incorporated by reference.

TECHNICAL FIELD

The present disclosure is directed, in general, to improved traffic monitoring and control systems and methods.

BACKGROUND OF THE DISCLOSURE

For reasons related to safety, efficiency, environmental concerns, and other issues, improved traffic control and monitoring systems are desirable.

SUMMARY OF THE DISCLOSURE

Various disclosed embodiments include methods, systems, and devices for monitoring roadway traffic. A method includes transmitting wireless signals from at least one roadside equipment (RSE) device and receiving responses by the RSE device from a wireless device, the responses including a unique identifier corresponding to the wireless device. The method includes determining a signal strength of each of the responses by the RSE device and transmitting response data from the RSE device to a control system, the response data including the unique identifier, the signal strength of each of the responses, and times that the responses were received. The method includes detecting at least one vehicle by the control system using a vehicle detection device and associating the response data with the detected vehicle. The method includes determining traffic information associated with the wireless device based on the received response data and the associated detected vehicle.

The foregoing has outlined rather broadly the features and technical advantages of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiment disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

Figure 1:
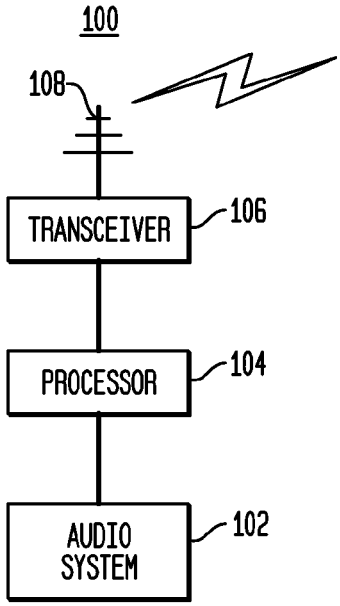
FIG. 1 depicts a simplified block diagram of a wireless device such as an onboard equipment system in accordance with disclosed embodiments.

FIGS. 1 through 5, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. The numerous innovative teachings of the present application will be described with reference to exemplary non-limiting embodiments.

Efficient traffic management can be accomplished using intelligent traffic control systems that are able to detect vehicles in the area of a traffic control device. Information about traffic flow and movements at an intersection is critical data which is very valuable for adaptive traffic control and signal plan optimization. Knowing how many cars come from a given direction and which fraction of them moves on to each of the possible directions leading away from the intersection can be very important for correct optimization of signal plans at an intersection.

Disclosed embodiments include systems and methods in which individual wireless devices, including devices in vehicles, broadcast information to be received and processed by the traffic control system, which can use the information to determine such information as the speed and direction of travel of the wireless device or vehicle. Other vehicle data can be collected using vehicle detectors such as loop detectors, radar, video detectors, etc. to detect and collect information about vehicles in real-time. Disclosed embodiments can combine existing loop detectors with inexpensive roadside radio equipment to produce attractive alternative that yields valuable data for most applications. The broadcast information can be, for example, a unique ID of the wireless device, and can include other information such as speed and direction of travel of the vehicle, and other information.

As described herein and in the related patent application referenced above and incorporated herein, the systems and methods disclosed herein include various means of using wireless devices, including onboard equipment (OBE) installed or used in a vehicle and other wireless devices in the vicinity of an intersection, and roadside equipment (RSE) that detects the vehicle by communicating with the OBE. Of course, in various embodiments, some or all of the components of the RSE could be physically located other than "roadside", such as in a cabinet, traffic controller, signal head, or otherwise. The RSE can be used to control many different types of traffic equipment, and can be used to collect and send data to a central monitoring station for further analysis or action, using common networking and communication techniques.

For the OBE and RSE, radio technology can be used, and in particular, Bluetooth® wireless technology as described by the BLUETOOTH SPECIFICATION Version 4.0 (Jun. 30, 2010) by Bluetooth SIG, Inc., hereby incorporated by reference, can be used to implement techniques as described herein. Devices and processes that conform to this specification will be referred to herein as "Bluetooth®-compliant". Instead of Bluetooth® technology, other wireless communication technology can be used in other embodiments in a similar way as described in detail below. For example, other suitable wireless technologies include WiFi (IEEE 802.11b/g/n) and DSRC (IEEE 802.11p).

Disclosed embodiments include an RSE system and method that can correlate device detection events gathered through radio frequency with vehicle detector actuations, such as loop detectors or other technology, in order to get accurate measurements of actual traffic flow and movement for better adaptive control. A loop detector, as described herein, can be an induction loop used to detect vehicles passing or arriving at a certain point, for instance approaching a traffic light, and in motorway traffic management. For example, an insulated, electrically conducting loop is installed in the pavement. A control system transmits energy into the wire loops at frequencies between 10 kHz to 200 kHz, depending on the model. The inductive-loop system behaves as a tuned electrical circuit in which the loop wire and lead-in cable are the inductive elements. When a vehicle passes over the loop or is stopped within the loop, the vehicle induces eddy currents in the wire loops, which decrease their inductance. The decreased inductance actuates the electronics unit output relay or solid-state optically isolated output, which sends a pulse to the control system signifying the passage or presence of a vehicle.

Disclosed techniques include using strategically placed Bluetooth® receivers, or similar wireless technology such as but not limited to WiFi and dedicated short-range communications (DSRC), at an intersection in order to gain further insight in traffic movements. Movement flow can be, for example, determined as a fraction to the total flow coming in from a given direction. By correlating that data with loop detector or other vehicle-detection data, even counts for each movement can be extrapolated. Further, the vehicle-detection data can be used to eliminate "extra" wireless detections that may be caused, for example, by multiple Bluetooth® or similar devices in a single vehicle, or Bluetooth® devices that may be carried by pedestrians. As used herein, "movement" refers to the specific path of a vehicle or wireless device through an intersection determined by entry direction and exit direction.

FIG. 1 depicts a simplified block diagram of a wireless device 100 such as an onboard equipment system in accordance with disclosed embodiments. In this diagram, processor 104 is connected between audio system 102 and transceiver 106, such that the processor 104 processes audio signals to and from audio system 102, and can transmit corresponding signals using transceiver 106 and antenna 108. In particular, processor 104, transceiver 106, and antenna 108 can be implemented using a Bluetooth®-compliant or other wireless device, such as a user earpiece, mobile terminal such as a laptop, mobile phone, or smartphone, and in particular can be implemented as part of an automobile's electronics, where the audio system 102 can be the automobile audio system. In other embodiments, there may be no audio system in the wireless device. OBE system 100, in various embodiments, can perform one or more Bluetooth®-compliant processes or operations as described herein.

Those of skill in the art will recognize that not all other details are shown in this simplified diagram. For example, audio system 102 can be the audio system of an earpiece, mobile telephone, or computer system, or may also be connected to an automobile navigation system, an emergency-communication system, or to other components of an automobile. The audio system 102, processor 104, and transceiver 106 will each also be connected to a power source, such as a vehicle power source, and may each be connected to other systems and components of a vehicle. The processor 104, and other components, can be connected to read and write to a storage such as volatile and non-volatile memory, magnetic, optical, or solid-state media, or other storage devices. The antenna 108 may be dedicated to transceiver 106, or may be connected to be shared with other components. Processor 104 may be configured to perform only the processes described herein, or can also be configured to perform other processes for the operation and management of the vehicle. The various components of FIG. 1 could be constructed as separate elements connected to communicate with each other, or two or more of these components could be integrated into a single device. In some embodiments, the "audio system" 102 is not necessarily or exclusively an audio system, but can be another Bluetooth®-compliant device such as a computer, mobile telephone, or otherwise, and can perform other functions such as file transfers and otherwise.

Figure 2:
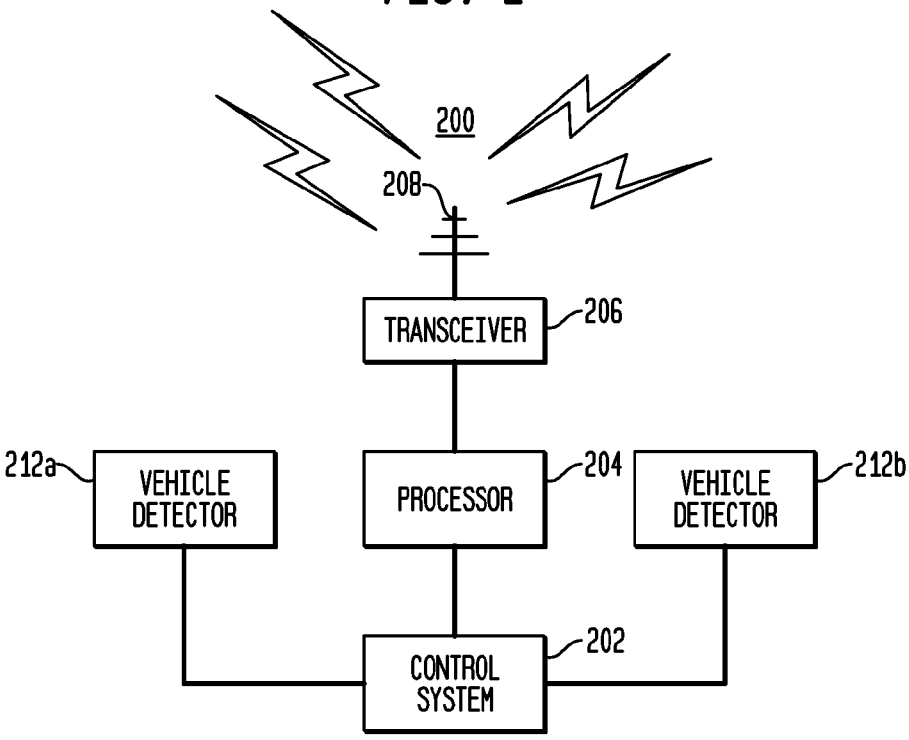
FIG. 2 depicts a simplified block diagram of a roadside equipment device in accordance with disclosed embodiments.

FIG. 2 depicts a simplified block diagram of a roadside equipment (RSE) device 200, in accordance with disclosed embodiments, that can be configured to perform processes as described herein. In this diagram, processor 204 is connected between a control system 202 and a transceiver 206. In particular, processor 204, transceiver 206, and antenna 208 can be implemented as a Bluetooth®-compliant device, and can perform one or more Bluetooth®-compliant processes or operations as described herein. The RSE device is an example of means for detecting wireless devices, such as Bluetooth®-compliant receivers or other OBE devices, traveling on a roadway. In some cases, an RSE can have multiple antennas that can be co-located, separated, oriented, or otherwise arranged to provide suitable transmission and reception for the location of the RSE. The RSE can also function as a vehicle detecting means when it includes a vehicle detector as described herein.

The transceiver 206 sends data to and receives data from the wireless device 100 and then communicates it to processor 204. The processor 204 can then communicate with control system 202, which can use it for traffic control, monitoring, and management processes, as described in more detail herein. Control system 202 can be a signal controller, or a traffic signal with integrated controller, or other system configured to control traffic equipment, and in particular can be a centralized server system. In various embodiments, control system 202 can be connected to and can communicate with multiple RSE systems 200, each of which include a processor 204, transceiver 206, and antenna 208.

RSE device 200 can also include one or more vehicle detectors, illustrated here as vehicle detectors 212*a* and 212*b*. Note that various embodiments can include multiple vehicle detectors at each intersection, and specific embodiments include a separate vehicle detector placed to detect vehicles at each lane entering an intersection. Many sections already have loop detectors installed in these locations for use in signal control, and these existing loop detectors can be leveraged using techniques disclosed herein. In other implementations, a single vehicle detector such as a camera system can be used to detect vehicles in multiple lanes and to determine the lane and direction of travel of each vehicle.

Those of skill in the art will recognize that not all other details are shown in this simplified diagram. For example, control system 202, processor 204, and transceiver 206 will each also be connected to a power source, and may each be connected to other systems and components of the RSE. The processor 204, and other components, can be connected to read and write to a storage such as volatile and non-volatile memory, magnetic, optical, or solid-state media, or other storage devices. The antenna 208 may be dedicated to transceiver 206, or may be connected to be shared with other components. Processor 204 may be configured to perform only the processes described herein, or can also be configured to perform other processes for the operation and management of the RSE. The various components of FIG. 2 could be constructed as separate elements connected to communicate with each other, or two or more of these components could be integrated into a single device. In particular, processor 204 can be an integral part of the control system 202, and perform many or all of the other functions of the RSE. In other embodiments, there may be multiple processors 204, transceivers 206, or antennas 208.

In some embodiments, the vehicle detectors are not integrated with the RSE device 200, but are separate and directly connected to a control system.

Figure 3:
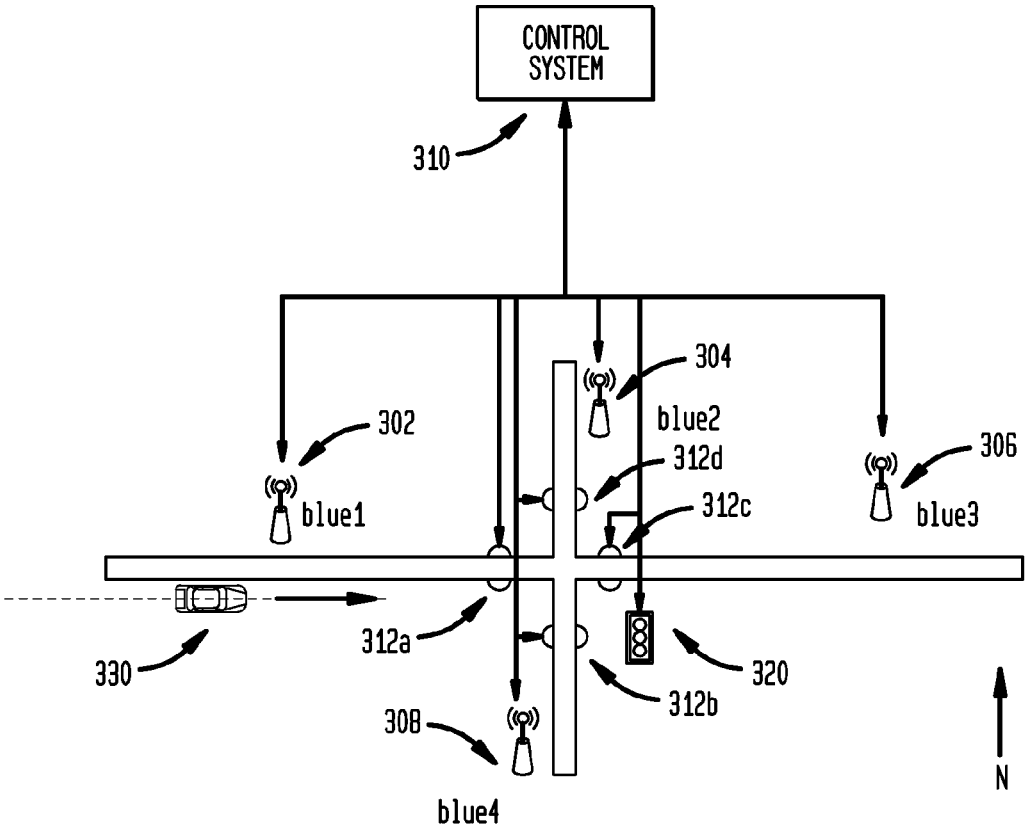
FIGS. 3 and 4 depict examples of implementations at an intersection, in accordance with disclosed embodiments.

Disclosed embodiments have particular use in traffic control and monitoring systems. FIG. 3 depicts an example of an implementation on an intersection, in accordance with disclosed embodiments. Traffic Light Control (TLC) makes traffic data collection an important component of traffic management, and disclosed embodiments provide novel and effective means for accurate traffic data collection. One approach for data collection using Bluetooth® interfaces at traffic intersections in order to estimate the average travel time for the vehicles is disclosed in U.S. Patent Publication 2010/0302070A1 to Puckett, et al., hereby incorporated by reference.

In the example of FIG. 3, an intersection is shown with multiple roadside equipment devices such as RSE 200, shown as blue1 302, blue2 304, blue3 306, and blue4 308, each of which can be Bluetooth®-compliant devices. Blue1 302, blue2 304, blue3 306, and blue4 308 are each connected to communicate with control system 310. Further, a plurality of vehicle detection devices 312*a*, 312*b*, 312*c*, and 312*d* are also connected to communicate with control system 310. While this simplified illustration only shows a single vehicle detection device at each side of the intersection, those of skill in the art will understand that each vehicle detection device 312*a*, 312*b*, 312*c*, and 312*d* may represent one or more actual vehicle detection devices such as loop detectors, pressure sensors, cameras, or others, and typically can represent sufficient vehicle detection devices to detect vehicles in each lane of traffic moving toward the intersection, referred to herein as "entry lanes".

Control system 310 can also be connected to control traffic signal 320 at the intersection. In some embodiments, one or more of the RSEs at an intersection can be integrated with the traffic signals or other equipment at an intersection. For example, RSE blue1 302 can be integrated with traffic signal 320; in intersections with multiple traffic signals, an RSE could be integrated with each traffic signal in each direction.

In this example, blue1 302 is to the west (or on the west side) of the intersection, blue2 304 is to the north (or on the north side) of the intersection, blue3 306 is to the east (or on the east side) of the intersection, and blue4 308 is to the south (or on the south side) of the intersection.

In various embodiments, all RSEs remain in scan/inquiry mode, continuously searching for OBEs. For example, each Bluetooth®-compliant RSE device 200 including blue1 302, blue2 304, blue3 306, and blue4 308 can perform a "paging" operation where it transmits a train of page messages until a response is received from an OBE device or a timeout occurs. Each RSE 200 can act, in various embodiments, as a paging device. Alternately or additionally, each RSE 200 including blue1 302, blue2 304, blue3 306, and blue4 308 can perform an "inquiry" procedure where it transmits inquiry messages and listens for responses in order to discover the other Bluetooth®-compliant devices that are within its respective coverage area; each RSE 200 can act, in various embodiments, as an inquiring device.

Control system 310 can combine the input from the RSEs, which identifies Bluetooth®-compliant OBEs, with the input from vehicle detection devices, which identifies vehicles. By combining this data, the control system 310 can determine, for example, when multiple detected OBEs only correspond to a single detected vehicle, and so should only be "counted" as a single vehicle. This may happen, for example, when a bus or other vehicle carries multiple OBE devices. Similarly, control system 310 can determine a detected OBE does not correspond to any detected vehicle, which could indicate, for example, that the OBE is a Bluetooth®-compliant device carried by a pedestrian or bicyclist. Conversely, control system 310 can determine when a vehicle is detected but no OBE is detected, and can then determine, for example, a proportion of vehicles that cannot be tracked using wireless techniques as described herein.

In the example of FIG. 3, there are four RSEs installed, including blue1 through blue4; however those of skill in the art will recognize that the number of RSEs/interfaces to be deployed and the places to deploy these RSEs/interfaces can vary from setting to setting. In other embodiments, such as in FIG. 4 below, an RSE uses one antenna (or one directional antenna) per possible approach/departure direction to/from the intersection, and each antenna can be associated with its corresponding direction. Overlap of antenna detection ranges is allowed but is preferably only a partial overlap. The portion of the exclusive (non-overlap) detection range of each antenna is preferably aligned with the approach/departure direction associated with that antenna.

Figure 4:
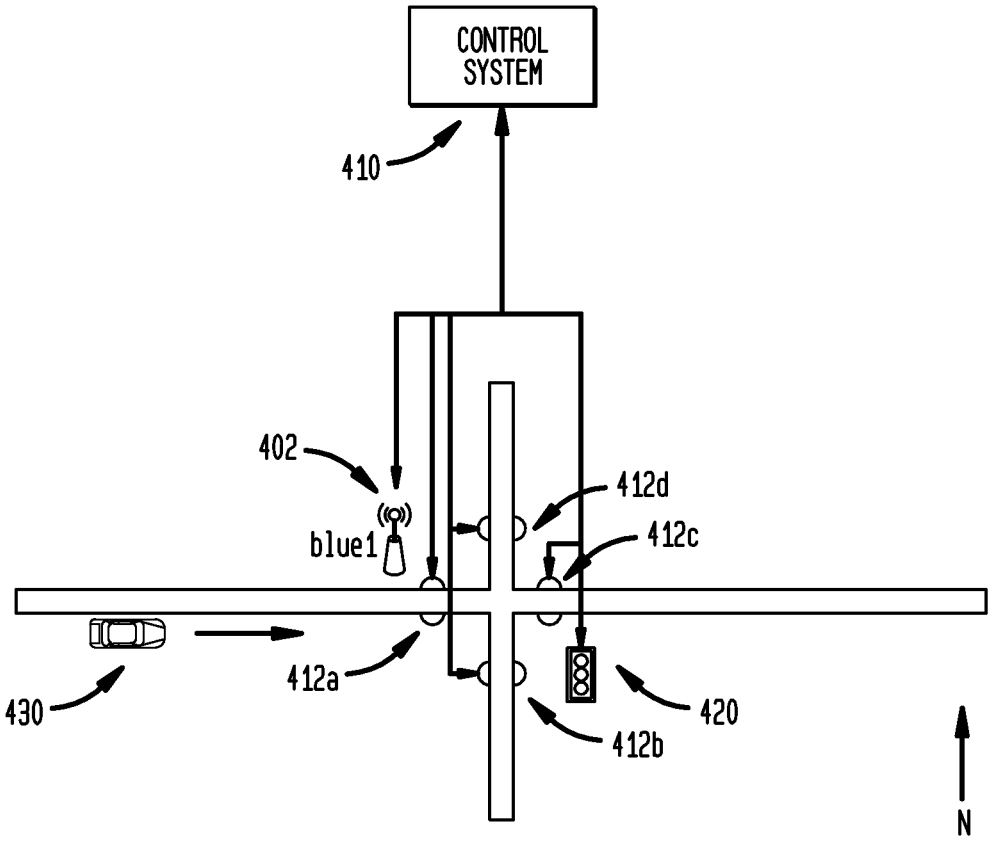

FIG. 4 depicts an example of an implementation on an intersection, in accordance with disclosed embodiments. Traffic Light Control (TLC) makes traffic data collection an important component of traffic management, and disclosed embodiments provide novel and effective means for accurate traffic data collection.

In the example of FIG. 4, an intersection is shown with a single roadside equipment device such as RSE 200, shown as blue1 402, which can be a Bluetooth®-compliant device. Blue1 402 is connected to communicate with control system 410. In this example, RSE blue1 402 is placed proximate to the intersection, and has multiple directed antennas, for example, a separate directed antenna directed in each direction from the intersection. In this way, blue1 402 can perform the detection functions described herein in each direction of the intersection, while requiring only a single physical receiver system.

Further, a plurality of vehicle detection devices 412*a*, 412*b*, 412*c*, and 412*d* are also connected to communicate with control system 410. While this simplified illustration only shows a single vehicle detection device at each side of the intersection, those of skill in the art will understand that each vehicle detection device 412*a*, 412*b*, 412*c*, and 412*d* may represent one or more actual vehicle detection devices such as loop detectors, pressure sensors, cameras, or others, and typically can represent sufficient vehicle detection devices to detect vehicles in each lane of traffic moving toward the intersection.

Control system 410 can also be connected to control traffic signal 420 at the intersection. In some embodiments, one or more of the RSEs at an intersection can be integrated with the traffic signals or other equipment at an intersection. For example, RSE blue1 402 can be integrated with traffic signal 420; in intersections with multiple traffic signals, an RSE could be integrated with each traffic signal in each direction.

In various embodiments, all RSE blue1 402 remains in scan/inquiry mode in each direction, continuously searching for OBEs. For example, each Bluetooth®-compliant RSE device 200 including blue1 402 can perform a "paging" operation where it transmits a train of page messages until a response is received from an OBE device or a timeout occurs. Each RSE 200 can act, in various embodiments, as a paging device. Alternately or additionally, each RSE 200 including blue1 402 can perform an "inquiry" procedure where it transmits inquiry messages and listens for responses in order to discover the other Bluetooth®-compliant devices that are within its respective coverage area; each RSE 200 can act, in various embodiments, as an inquiring device.

In the example of FIG. 4, there is a single RSE installed, blue1 402; however, those of skill in the art will recognize that the number of RSEs/interfaces to be deployed and the places to deploy these RSEs/interfaces can vary from setting to setting.

The RSEs continuously collect information about the OBEs or other wireless devices close to them, together with the received signal strength of the wireless response messages; in Bluetooth®-compliant systems, this is the Received Signal Strength Indication (RSSI).

The RSEs can use, for example, a Bluetooth®-compliant Read RSSI command to read the value for the RSSI for a Connection_Handle to another controller. In a Bluetooth®-compliant embodiment, the Connection_Handle is used as the handle command parameter and return parameter. The RSSI parameter returns the difference between the measured Received Signal Strength Indication (RSSI) and the limits of a Golden Receive Power Range for a Connection Handle to another controller. The Connection_Handle must be a Connection_Handle for an ACL connection. Any positive RSSI value returned by the Controller indicates how many dB the RSSI is above the upper limit, any negative value indicates how many dB the RSSI is below the lower limit. The value zero indicates that the RSSI is inside the Golden Receive Power Range. The RSSI measurement compares the received signal power with two threshold levels, which define the Golden Receive Power Range. The lower threshold level corresponds to a received power between −56 dBm and 6 dB above the actual sensitivity of the receiver. The upper threshold level is 20 dB above the lower threshold level to an accuracy of +/−6 dB.

In some embodiments, the upper and lower threshold levels can be adjusted to a very narrow Golden Receive Power Range so that the majority of RSSI results will be positive and negative values.

Returning to the example of FIG. 3, the control system 310 can collect information at all times from the RSEs and has information about each OBE detected by each RSE, alone with each OBE device's ID and RSSI as a function of time. At the same time, vehicle detection devices detect each vehicle and its lane of travel as it enters the intersection. This information enables the control system to determine the direction of the vehicle and to project its route.

In an example implementation, as illustrated in FIG. 3, as car 430 proceeds along the road, blue1 302, blue2 304, blue3 306, and blue4 308 are performing a paging or inquiry operation, while the OBE in car 330 is performing a page scan or responding to inquiries. For simplicity of description, the operations of an OBE 100 in car 330 may be referenced below as the operations of car 330 itself.

Car 330 responds to the page messages or inquiry messages from blue1 302 by sending a response that includes its unique identifier (ID). The unique ID is registered by the Bluetooth interface blue1 and relayed to centralized control system 310. Control system 310 can be, for example, one or more server data processing systems having processors, memories, and storage, and is configured to perform actions as described herein. Control system 310 is an example of means for analyzing data produced by the RSE devices, and also can include means for controlling traffic signals or other equipment. The process above can be performed by each of the RSEs.

The on-board equipment such as OBE 100 in car 330 has a unique identifier; optionally, each RSE 200 including blue1 302-blue4 308, also has a unique identifier. In a Bluetooth® implementation, the unique identifier can be a Bluetooth Device Address (BD_ADDR), which is a 48-bit address used to identify each Bluetooth® device. The OBE is a connectable device in range that periodically listens on its page scan physical channel and will respond to a page on that channel or a device that is advertising using a connectable advertising event. Alternately or additionally, the OBE is a device that listens for and responds to inquiry messages received on its inquiry scan physical channel.

Each RSE 200 including blue1 302 and blue2 304 can perform a "paging" operation where it transmits a train of page messages until a response is received from the target OBE device or a timeout occurs. Each RSE 200 can act, in various embodiments, as a paging device. Alternately or additionally, each RSE 200 including blue1 302 and blue2 304 can perform an "inquiry" procedure where it transmits inquiry messages and listens for responses in order to discover the other Bluetooth devices that are within its respective coverage area; each RSE 200 can act, in various embodiments, as an inquiring device.

Assume in this example that car 330 approaches the intersection from the West, travelling East. As it first approaches, its OBE is first detected by RSE 302 blue1, with a relatively weak signal strength. As car 330 nears the intersection, the signal strength detected by RSE 302 blue1 increases, and it will eventually be detected by blue2 304 and blue4 308, and then blue3 306, with an initially-weak signal strength. At the same time, vehicle detection device 312*a* detects the vehicle and its lane as it enters the intersection. As the car 330 approaches and passes each RSE, the signal strength for that OBE's unique ID will be transmitted to the control system 310, which will observe the signal strength increasing as the car 330 approaches each respective RSE, then decreasing again as the car 330 moves farther away again.

Control system 310 can then analyze the collected information from all the blue1 302, blue2 304, blue3 306, blue4 308, and other connected RSEs, as well as the collected information from vehicle detection devices 312*a*-312*d* in order to compute traffic related statistics such as the average speed or direction of individual vehicles and traffic as a whole, since control system 310 can also know the locations of and distances between the RSEs. Control system 310 may also use this information to control traffic signal 320 or other traffic control devices. Control system 310 can also determine traffic patterns from this data, including the numbers or proportion of vehicles that travel straight through the intersection, turn right, or turn left.

The control system 310 can maintain, in memory or other storage, data related to the OBEs detected by the RSEs at any given time. The table below is a non-limiting example of such data. The "Device" column represents the unique ID for an OBE device, the "Time" column indicates the time at which that device ID was detected by each RSE, for example by receiving a response to a paging or inquiry message sent by the respective OBE, and the other columns indicate the received signal strength for the device ID for the respective RSE. Note that, for simplicity of this example, the received signal strengths are simply listed as low, medium, or high (or as a "-" for no detection).

| Device | Detect | Time | blue1 | blue2 | blue3 | blue4 |
|---|---|---|---|---|---|---|
| AA:BB:CC: DD:EE:FF | | (12:42:25) | — | — | — | — |
| AA:BB:CC: DD:EE:FF | | (12:42:45) | Low | — | — | — |
| AA:BB:CC: DD:EE:FF | | (12:43:05) | Medium | Low | — | Low |
| AA:BB:CC: DD:EE:FF | 312a/2 | (12:43:25) | High | Medium | Low | Medium |
| AA:BB:CC: DD:EE:FF | | (12:43:45) | Medium | Medium | Medium | Medium |
| AA:BB:CC: DD:EE:FF | | (12:44:05) | Low | Medium | High | Medium |
| AA:BB:CC: DD:EE:FF | | (12:44:25) | — | Low | Medium | Low |
| AA:BB:CC: DD:EE:FF | | (12:44:45) | — | — | Low | — |
| AA:BB:CC: DD:EE:FF | | (12:45:05) | — | — | — | — |

Note that in this example, as car 330 approaches from the west and passes east through the intersection, the signal strength data collected by control system 310 shows that the signal strength at blue1 302, to the west of the intersection, increases from low to high as the car 330 approaches and decreases from high to low (and then not detected) as the car 330 moves away again. The signal strength at blue3 306, to the east of the intersection, mirrors the signal strength at blue 1, but is delayed by 40 seconds, showing that the car 330 approached and moved past blue3 306 about 40 seconds after it passed blue1 302. Note also that as the car 330 reaches the intersection, it is detected by vehicle detection device 312*a* in lane 2 (indicated as 312*a*/2), showing it entered the intersection in the eastbound lane 2 on the west side of the intersection.

The signal strength at blue2 304 and blue4 308 never increased above a "medium" level, and shows that car 330 did not travel to the north or south of the intersection, and the combined and substantially identical and synchronized strengths shows that car 330 passed through the intersection between them traveling in a latitudinal direction.

If, instead, car 330 had turned north at the intersection, for example, then the signal strength at blue2 304 would have continued to increase, but the signal strength at blue3 306 and blue4 308 would not have continued to increase. In this way, the system can determine the travel speed, direction, and projected route of the vehicle associated with the OBE, or can include information about traffic conditions by aggregating received data associated with multiple other OBEs, such as average traffic speed, traffic control efficiency, delays caused by traffic signals, and other information. Further, by using the signal strength to determine the direction taken by car 330 after it has entered the intersection, the system need not include vehicle detection devices at each of the "exit" lanes of the intersection.

By matching identical IDs and timestamps picked up by all RSEs in each direction, and associating these with detected vehicles, it the system can determine the fraction of vehicles travelling on each possible movement. For example, the system can determine, for each direction from which vehicles can enter the intersection percentages of vehicles leaving the intersection in each possible exit direction (also referred to as "movements").

It is assumed that each OBE device will be picked up by at least two antennas out at the intersection and a direction of travel and movement will be associated for this pair. Associating this data with vehicle detection data enables the system to discard pedestrians and parked/stopped vehicles from the sample data.

As described herein, in another example, disclosed embodiment can also "filter" a group of passengers on a vehicle such as a bus when processing the data. The system can use the collected data to ensure that each Bluetooth device carried on the bus is not counted as an individual vehicle. The techniques can be used with other vehicles that hold many passengers and/or are equipped with more than one separate Bluetooth device. The system can monitor all Bluetooth devices travelling through the array of receiver antennas and identify groups of such devices that enter and leave within a certain short time span of one another. Associating this information with detected vehicle data enables the system to count such groups as one vehicle.

As the loop detectors that usually exist at intersections provide counts of total cars approaching from a given direction, multiplying these values with the determined movement fractions will give an estimated count per movement. These values can then be used for local adaptive algorithms implemented in the controller as well as central adaptive systems (e.g. SCOOT) that need to know about movement fractions for better optimization performance. In addition to the loop detectors described herein, other vehicle detection devices that can be used to implement systems as described herein can include radar, infrared, the Sensys® "pucks" sensors, video detectors, and others.

Another measurement taken can be the amount of time a vehicle took from entering the intersection until leaving it. This measurement can be averaged for each approach direction and also each movement originating from that approach. This measurement, called Delay, would give a good indication of the amount of traffic backed up at an intersection waiting to get through it.

Antennas would preferably be placed such that enough ID signals are picked up reliably and to obtain a statistically significant sample. The antenna's range preferably will not overlap in order to avoid IDs being picked up by more than two antennas at the same time. Monitoring over time, combined with "entry lane" vehicle detection, helps disambiguate the actual direction of travel.

Figure 5:
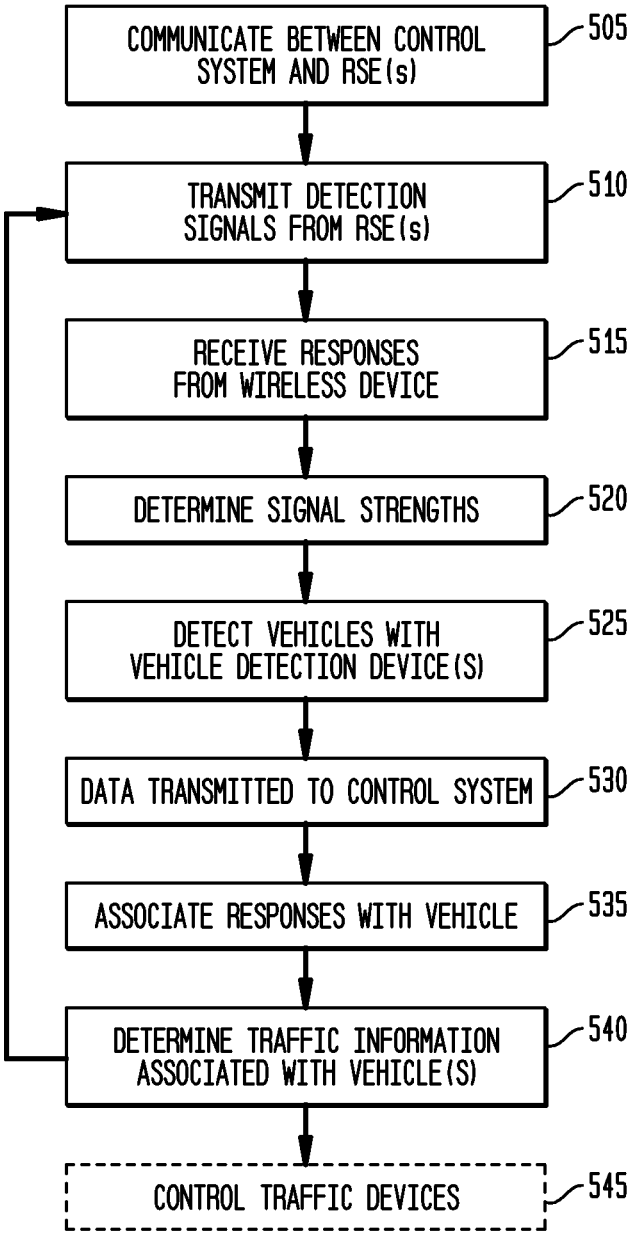
FIG. 5 depicts a process in accordance with disclosed embodiments.

FIG. 5 depicts a flowchart of a process in accordance with disclosed embodiments. The RSE steps described below can be performed by processor 204, in various embodiments. As used herein, the "system" will refer to the operations of control system 310 and one or more RSE devices 200 as a combined traffic monitoring system.

A control system communicates with one or more RSE devices located at an intersection (step 505), including at least a first RSE device that has a wireless receiver as described herein and a vehicle detection device as described herein.

In some embodiments, there may be a single RSE device with directed receivers/antennas that can detect OBEs in multiple directions from the intersection. The RSE includes a transceiver that can determine received signal strengths.

In other embodiments, there may be at least a first RSE device and a second RSE device located at separated positions near the intersection. The RSE devices are located on different sides of an intersection, and each includes a transceiver that can determine received signal strengths. The RSE devices can each be located at an intersection or other location proximate to a roadway, and in other embodiments, can be located at positions on a roadway not proximate to an intersection.

The RSE device(s) transmits wireless signals to detect a wireless device (step 510). These signals can be, for example, Bluetooth®-compliant paging or inquiry messages, and the wireless device can be an OBE device, including a Bluetooth®-compliant device in a vehicle. The RSE device(s) and the wireless devices are configured for Bluetooth®-compliant communications which can include but is not limited to this specific messaging.

The RSE device(s) receives responses from the wireless device (step 515). Each response includes a unique identifier corresponding to the wireless device. The responses can be received at the same (or approximately same) time, or at different times. In a typical implementation, one of the RSEs will receive a response before the other, indicating that the wireless device and the vehicle in which it is mounted or traveling is approaching from that direction.

The RSE device(s) determines signal strengths of the received responses (step 520).

The control system detects vehicles using one or more vehicle detection devices (step 525). These vehicle detection devices can be integrated with the RSE device(s), or can be separate and directly connected to the control system.

The RSE device(s) transmits response data to the control system (step 530). The response data can include the unique identifier, the time(s) at which the RSE device(s) received the responses, and the signal strengths.

The control system associates the received response data and the corresponding wireless device with one of the detected vehicles (step 535). This can include performing any of the "filtering" functions described herein.

The system can optionally repeat steps 510-535 on an occasional, periodic, or continuous basis in order to accumulate data for multiple vehicles, and preferably a large enough number of vehicles to be a representative traffic sample for a time and day of the week.

Based on the received data, the control system determines traffic information associated with the vehicle (or the multiple vehicles) (step 540). The traffic information can include information specific to that vehicle, for example the travel speed, direction, movement, and projected or detected route of the vehicle, the delay at an intersection, duration through the intersection, or average speed through the intersection, or can include information about traffic conditions by aggregating received data associated with multiple other vehicles, such as average traffic speed, traffic control efficiency, delays caused by traffic signals, and other information. The system can also determine such information as the percentage of traffic that turns at the intersection, which directions, and the corresponding times and days of the week. As described in detail above, the traffic information can be determined based on relative signal strengths of the responses received by the RSE device(s) at respective times. In this way, the control system can act as analyzing means for analyzing the received data. Alternately or additionally, the traffic information can include similar information about non-vehicle traffic, i.e., pedestrian traffic.

The control system can control traffic control devices based on the traffic information (step 545). This can include operating traffic signals, information displays, streetlamps, and other traffic control and information devices as known to those of skill in the art. In this way, the control system, alone or in combination with one or more traffic control devices, can act as traffic control means.

The process above can be performed repeatedly and simultaneously for a plurality of wireless devices and a plurality of RSEs, to constantly receive and analyze data regarding the travel of vehicles past and between RSEs, and to perform other control or monitoring tasks using that data. In particular, steps 510-540 can be performed continuously to constantly accumulate responses from the wireless device, and send the data to the control system, while the wireless device is within range of the RSEs.

In other embodiments, the vehicle-detection process can be used to determine wireless devices that are not OBEs, such as wireless devices carried by pedestrians. Using techniques as described herein, OBE data can be excluded in order to compile data related to non-vehicle travel and movement, such as the number or percentage of pedestrians that cross the intersection at specific points and in specific directions. In some embodiments, percentage values of movements can be determined without vehicle detection devices, just using the Bluetooth® or other wireless data. Pedestrians can be removed from the sample because they move too slowly. Multiple devices on one vehicle could be ruled out by monitoring the signal strength profile over time of each device on-board and determining that they are just too close together to be on separate vehicles. Further, in some embodiments, specific counts for each movement can be determined using wireless detection in combination with vehicle detectors, even where finding movement percentages is performed using just the wireless detection. Using the vehicle detector data can further enhance the quality of the data gathered by the wireless system.

Disclosed embodiments provide distinct technical advantages in traffic control and monitoring, as described herein, and in particular since modern vehicles or their passengers are typically equipped with wireless devices including Bluetooth®-compliant devices. In some embodiments, specific unique IDs can be associated with emergency vehicles, and the traffic control system can control traffic control devices, including traffic signals, to allow the emergency vehicle to travel efficiently.

Techniques as described herein can be used in combination with adaptive traffic control algorithms (e.g. ACS Lite or SCOOT) to improve their effectiveness and efficiency.

Adaptive control such as ACS Lite could further be improved to run in a "suggestion mode" where it would use data produced using techniques disclosed herein along with other data to automatically calculate optimized signal plans for an intersection and the current traffic situation. It would then compare this plan to the currently running plan and suggest to the user to implement the optimized plan with user's permission.

Disclosed techniques can be used to present improved Key Performance Indicators (KPIs) to users including Delay, travel times, and Origin-Destination-Data (O-D data). Disclosed techniques can also be used with an application that informs users of high levels of turn movements at a given intersection. This can be helpful, for example, for blind pedestrians, other disabled persons and bicyclists when planning a route.

Other traffic control systems are described in Bakker, B.; Whiteson, S.; Kester, L.; Groen, F. C. A. "Traffic light control by multiagent reinforcement learning systems", Interactive collaborative information systems, Vol. 281, p. 475-510, hereby incorporated by reference.

Those skilled in the art will recognize that, for simplicity and clarity, the full structure and operation of all systems suitable for use with the present disclosure is not being depicted or described herein. Instead, only so much of an OBE and an RSE system as is unique to the present disclosure or necessary for an understanding of the present disclosure is depicted and described. The remainder of the construction and operation of the systems disclosed herein may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs).

Although an exemplary embodiment of the present disclosure has been described in detail, those skilled in the art will understand that various changes, substitutions, variations, and improvements disclosed herein may be made without departing from the spirit and scope of the disclosure in its broadest form. None of the description in the present application should be read as implying that any particular element, step, or function is an essential element which must be included in the claim scope: the scope of patented subject matter is defined only by the allowed claims. Moreover, none of these claims are intended to invoke paragraph six of 35 USC §112 unless the exact words "means for" are followed by a participle.

What is claimed is:

1. A method, comprising:

transmitting wireless signals from at least one roadside equipment (RSE) device;

receiving responses by the RSE device from a wireless device, the responses including a unique identifier corresponding to the wireless device;

determining a signal strength of each of the responses by the RSE device;

transmitting response data from the RSE device to a control system, the response data including the unique identifier, the signal strength of each of the responses, and times that the responses were received;

detecting at least one vehicle by the control system using a vehicle detection device;

associating the response data with the detected vehicle; and determining traffic information associated with the wireless device based on the received response data and the associated detected vehicle.

2. The method of claim 1, wherein wireless signals and responses are Bluetooth®-compliant.

3. The method of claim 1, wherein the traffic information is determined based on relative signal strengths of the responses received by first and second RSEs at respective times.

4. The method of claim 1, wherein the traffic information includes a movement of the detected vehicle associated with the wireless device.

5. The method of claim 1, wherein the vehicle detection device includes a loop detector.

6. A method, comprising:

providing data communications between a control system and a roadside equipment (RSE) device;

providing data communications between the control system and vehicle detection device;

receiving data from the RSE device and the vehicle detection device by the control system, the data including a unique identifier for a wireless device associated with a vehicle detected by the vehicle detection device, times that responses were received from the wireless device by the RSE device, and signal strengths of each of the responses; and determining traffic information associated with the vehicle based on the received data.

7. The method of claim 6, wherein the RSE device and the wireless device are configured for Bluetooth®-compliant communications.

8. The method of claim 6, wherein the traffic information is based on a movement of the vehicle determined from the responses and the vehicle detection device.

9. The method of claim 6, wherein the vehicle detection device is a loop detector.

10. The method of claim 6, wherein the traffic information a percentage of vehicles that turn at an intersection based on multiple wireless devices and multiple detected vehicles.

11. A traffic monitoring system, comprising:

a control system; and at least one roadside equipment (RSE) device located at an intersection, comprising at least a processor and a wireless transceiver, the RSE device configured to transmit wireless signals and receive corresponding responses from a wireless device, and to send data to the control system corresponding to the responses, signal strengths of each of the response, and times the responses were received;

at least one vehicle detection device located at the intersection, configured to detect a vehicle in a specific lane of traffic, wherein the control system determines traffic information associated with the wireless device based on associating the detected vehicle with the received data and determining a movement of the vehicle.

12. The traffic monitoring system of claim 11, wherein wireless signals and responses are Bluetooth®-compliant.

13. The traffic monitoring system of claim 11, wherein the traffic information is determined based on relative signal strengths of the responses received by first and second RSEs from the vehicle at respective times.

14. The traffic monitoring system of claim 11, wherein the traffic information is based on determining movements of a plurality of detected vehicles.

15. The traffic monitoring system of claim 11, wherein the traffic information includes a percentage of vehicles that turn in a first direction at the intersection.

16. The traffic monitoring system of claim 11, wherein the control system controls a traffic control device based on the traffic information.

* * * * *